US011535442B2

(12) United States Patent
Yen et al.

(10) Patent No.: US 11,535,442 B2
(45) Date of Patent: Dec. 27, 2022

(54) FOAM SPRAY CAN

(71) Applicant: Fairway Electronic CO., LTD., New Taipei (TW)

(72) Inventors: Lin-Han Yen, New Taipei (TW); Yu-Jen Fang, New Taipei (TW)

(73) Assignee: FAIRWAY ELECTRONIC CO., LTD., New Taipei (TW)

( * ) Notice: Subject to any disclaimer, the term of this patent is extended or adjusted under 35 U.S.C. 154(b) by 125 days.

(21) Appl. No.: 17/158,039

(22) Filed: Jan. 26, 2021

(65) Prior Publication Data

US 2022/0234809 A1 Jul. 28, 2022

(51) Int. Cl.
*B65D 81/32* (2006.01)
*B65D 83/68* (2006.01)

(52) U.S. Cl.
CPC ..... *B65D 81/3222* (2013.01); *B65D 83/682* (2013.01)

(58) Field of Classification Search
CPC ..... B65D 81/3222; B65D 83/682
See application file for complete search history.

(56) References Cited

U.S. PATENT DOCUMENTS 5,803,596 A * 9/1998 Stephens ..... A62C 5/02 261/DIG. 26
10,076,760 B2 9/2018 Jacques
10,080,468 B2 9/2018 Ciavarella
2008/0061166 A1* 3/2008 Jacques ..... B05B 9/0816 239/373
2016/0044909 A1 2/2016 Lampe
2017/0143172 A1* 5/2017 Ciavarella ..... F04B 23/04
2017/0167290 A1* 6/2017 Kulkarni ..... F02C 7/22
2018/0043194 A1* 2/2018 Zimmerman ..... A62C 5/022
2018/0126396 A1* 5/2018 Ellis ..... B05B 7/0025
2018/0360259 A1* 12/2018 Savioz ..... B01F 23/2351
2019/0159636 A1* 5/2019 Lo ..... B05B 11/3001

FOREIGN PATENT DOCUMENTS

TW M613147 6/2021

OTHER PUBLICATIONS

Taiwan Patent Office "Office Action" dated Feb. 25, 2022, Taiwan.

* cited by examiner

*Primary Examiner* — J C Jacyna
(74) *Attorney, Agent, or Firm* — WPAT, PC

(57) ABSTRACT

A foam spray can comprises a motor pump, a foaming tube and a nozzle. The motor pump can be used to suck air and solution and pump out the liquid-gas mixture. One end of the foaming tube is connected to the motor pump for transmitting the liquid-gas mixture pumped by the motor pump and fully mixing the air with the solution to produce foam. The nozzle is connected to the other end of the foaming tube to spray foam. The length of the foaming tube is between 10 to 500 cm, the tube inner diameter is between 0.8 to 20 mm, and the pressure of the liquid-gas mixture in the tube is between 8 to 32 PSI, thereby to provide sufficient time, space and conditions for the mixing of the air and the solution in the foaming tube to fully mix the air and the solution, and then to spray abundant foam from the nozzle.

11 Claims, 4 Drawing Sheets

FOAM SPRAY CAN

FIELD OF THE DISCLOSURE

The present invention relates to a foam spray can, and more particularly to a foam spray can which can generate a large amounts of foam.

BACKGROUND

Spray can is a common and practical spraying appliance, which is widely used in different places such as home, office, school and so on because of its small size, small footprint, easy to portability and hand-held operation. Spray can is often used in scenes such as air humidification, water spraying for plant irrigation, and spraying of disinfectant and cleaning liquids. When cleaning and washing objects, the liquid sprayed by the spray can contains certain detergent or disinfectant, and the liquid will produce a certain amount of foam. At this time, the spray can is used as a foam spray can.

In the cleaning and washing of objects, such as vehicle cleaning, glass cleaning, the liquid sprayed by the foam spray can is required to have relatively rich foam and easy to use and operate. The existing foam spray can is usually filled with dense sponge in the nozzle part, and with the pores on the sponge, the liquid can be mixed through the sponge to produce rich foam. However, after a long time of use, the sponge will absorb impurities in the liquid and block some of the pores in the sponge. Moreover, in order to produce a large amount of foam, it is necessary to pack a denser sponge in the nozzle. However, in order to make the liquid pass through the dense sponge, it is necessary to increase the pressure of water injection, that is, the pressure in the foam spray can needs to be increased. The common design will increase the pressure in the pot by high-pressure gas injection into the foam spray can, but this will bring some security risks and inconvenience to its use.

Furthermore, although the existing foam spray can has a way of injecting gas into the pot to obtain rich foam, it needs to use a large amount of detergent, and is not environmentally friendly in use.

Therefore, the main purpose of the present invention is to provide a foam spray can which can generate rich foam without using high-pressure gas injection and use less detergent to solve the above-mentioned problems.

SUMMARY

The purpose of the present invention is to provide a foam spray can, which can fully mix air and solution in the pipeline without high-pressure gas injection to produce rich foam.

In order to achieve at least one of the advantages or other advantages, one embodiment of the present invention provides a foam spray can, comprising: a motor pump sucks air and solution and pumps out the liquid-gas mixture; a foaming tube, one end of which is connected to the motor pump, is used to transmit the liquid-gas mixture pumped by the motor pump and fully mix the air with the solution to produce foam, wherein the length of the foaming tube is between 10 cm and 500 cm, the inner diameter of the foaming tube is between 0.8 mm and 20 mm, and the pressure of the liquid-gas mixture in the foaming tube is between 8 and 32 PSI; and a nozzle is connected to the other end of the foaming tube for spraying foam.

In some embodiments, the ratio of the air to the solution in the liquid-gas mixture is between 1:1 and 10:1.

In some embodiments, the foam spray can further includes a first pipe and a second pipe. The first pipe is for inputting air into the motor pump. The second pipe is for inputting solution into the motor pump.

In some embodiments, the foam spray can further includes a pot body and a lid body. The pot body is used to contain the solution, and the lid body is used to contain the motor pump, the foaming tube, the first pipe and the second pipe.

In some embodiments, one end of the second pipe is connected to the motor pump, and the other end of the second pipe extends into the pot body to extract the solution.

In some embodiments, the solution includes water and detergent.

In some embodiments, the ratio of water to the detergent in the solution is between 1000:1 and 1:1.

In some embodiments, the foam spray can further includes a regulating valve. The regulating valve is connected between the first pipe and the motor pump for adjusting the amount of air injected into the motor pump by the first pipe.

In some embodiments, the foam spray can further includes a one-way valve. The one-way valve is arranged between the first pipe and the motor pump for preventing the solution from flowing out when the foam spray can is poured.

In some embodiments, the foaming tube is arranged inside the housing of the lid body in a spiral manner.

In some embodiments, the lid body further includes an upper cover and a lower cover. The lower cover has a hollow cavity. The hollow cavity has a socket. The socket is used for accommodating the motor pump.

In some embodiments, the lid body has a handle. A battery is arranged inside the handle to provide power for the motor pump.

In some embodiments, the lid body has a touch switch. The touch switch is located on the upper side of the handle and is used to control the switch of the motor pump.

Accordingly, by using the foam spray can provided by the present invention, the air and the solution sucked by the motor pump are fully mixed through the foaming tube, and a rich foam is sprayed out through a nozzle without high pressure gas injection. At the same time, the foam spray can is simple in structure, portable and convenient using.

The foregoing description is merely an overview of the technical solution of the present invention. In order to enable a clearer understanding of the technical means of the present invention, and thus it can be implemented in accordance with the teachings of the present invention, and to enable the above features and advantages of the present invention to be more clearly understood, the embodiments are described in detail with reference to the accompanying drawings.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
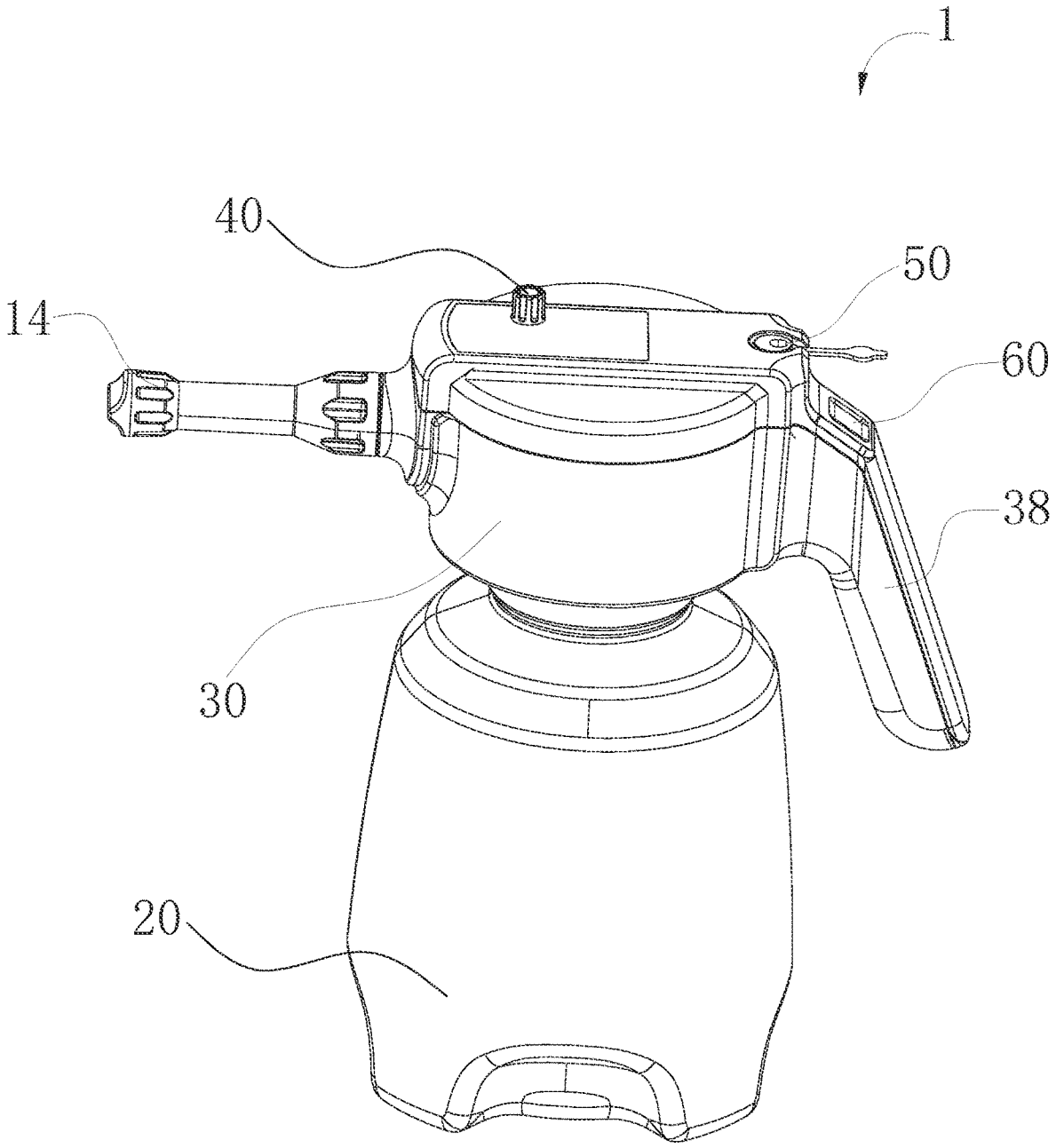
FIG. 1 is an overall view of a hand-held foam spray can of the present invention.

It should be noted, the embodiments illustrated herein are applied for explaining rather than limiting the present invention.

The specific structural and functional details disclosed herein are only representative and are intended for describing exemplary embodiments of the disclosure. However, the disclosure can be embodied in many forms of substitution and should not be interpreted as merely limited to the embodiments described herein.

In the description of the present invention, the terms for indicating orientations or positional relationships such as "center", "longitudinal direction", "above", "below", "left", "right", "vertical", "horizontal", "top", "bottom", "inside" and "outward" for indicating orientations or positional relationships refer to orientations or positional relationships as shown in the drawings; the terms are for the purpose of illustrating the disclosure and simplifying the description rather than indicating or implying the device or element must have a certain orientation and be structured or operated by the certain orientation, and therefore cannot be regarded as limitation with respect to the disclosure. In addition, the terms as "first" and "second" are used for describing purpose and cannot be interpreted as the instruction or hint about the importance nor be implied the quantity of characteristic elements. Thus, the feature limited with "first" or "second" may include one or more characteristic element. In description of the present invention, the implication of "multiple" is two or more unless otherwise indicated. Further, the terms "comprises," "comprising," or any other variation thereof, are intended to cover a non-exclusive inclusion.

In this invention, unless otherwise clearly defined and limited, the terms such as "installation", "being connected" and "connection" should be interpreted broadly, such as, can be fixedly connected with, also can be removably connected, or connected in one piece; and can be mechanically connected, also can be electrically connected; can be directly connected, also can be indirectly connected; can be connected by intermedia; can be the connection of two element internally. For the ordinary skilled in the art, the actual meaning of above-mentioned term in the present invention can be understood according to the specific situations.

The terms used herein are only for describing specific embodiments and are not intended to limit the exemplary embodiments. Unless the context clearly dictates otherwise, the singular forms such as "a" and "one" used herein are also intended to include the plural. It should also be understood that the terms "including" and/or "comprising" used herein specify the existence of the stated features, integers, steps, operations, units and/or components, and do not exclude the existence or addition of one or more other features, integers, steps, operations, units, components, and/or combinations thereof.

Figure 2:
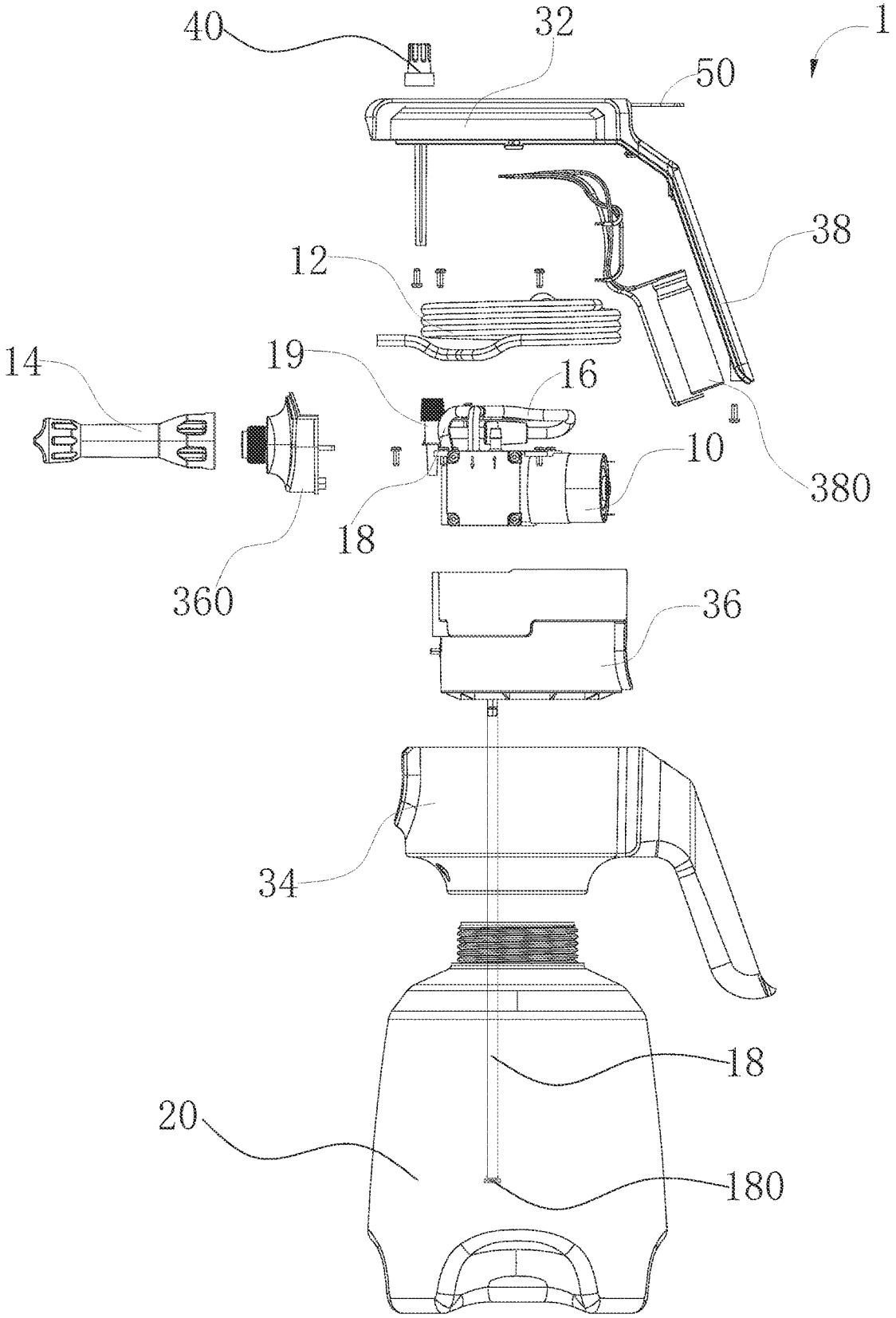
FIG. 2 is an exploded view of the hand-held foam spray can shown in FIG. 1.

To facilitate understanding, the illustration of the specific embodiment of the foam spray can in this case is illustrated by a hand-held foam spray can 1 as an example for explanation. Please refer to FIG. 1 and FIG. 2, FIG. 1 is an overall view of a hand-held foam spray can of the present invention, and FIG. 2 is an exploded view of the hand-held foam spray can shown in FIG. 1. In order to achieve at least one of the advantages or other advantages, a hand-held foam spray can 1 in one embodiment of the present invention comprises a motor pump 10, a foaming tube 12 and a nozzle 14. The motor pump 10 can be used to suck air and solution and pump out the liquid-gas mixture. One end of the foaming tube 12 is connected to the motor pump 10 to transmit the liquid-gas mixture pumped by the motor pump 10, the foaming tube 12 make the air fully mixed with the solution to generate foam. The other end of the foaming tube 12 is connected to the nozzle 14, and the foam is sprayed through the nozzle 14. The length of the foaming tube 12 is between 10 cm and 500 cm, the inner diameter of the foaming tube 12 is between 0.8 mm and 20 mm, and the pressure of the liquid-gas mixture in the foaming tube 12 is between 8 and 32 PSI. Such setting provides sufficient time, space and conditions for the mixing of the air and the solution in the foaming tube 12 to fully mix, and then the nozzle 14 sprays a rich foam.

In a specific embodiment, the ratio of the air to the solution in the liquid-gas mixture is between 1:1 and 10:1. The hand-held foam spray can 1 may be used for the common cleaning purpose, such as vehicle cleaning, glass cleaning. In this gas-liquid mixing ratio, the mixing uniformity, fluidity, and foaming ratio of the liquid-gas mixture are in a better state of use, and can produce rich and certain foam with a certain degree of fineness, thereby ensuring the cleaning or cleaning effect of different needs.

Figure 3:
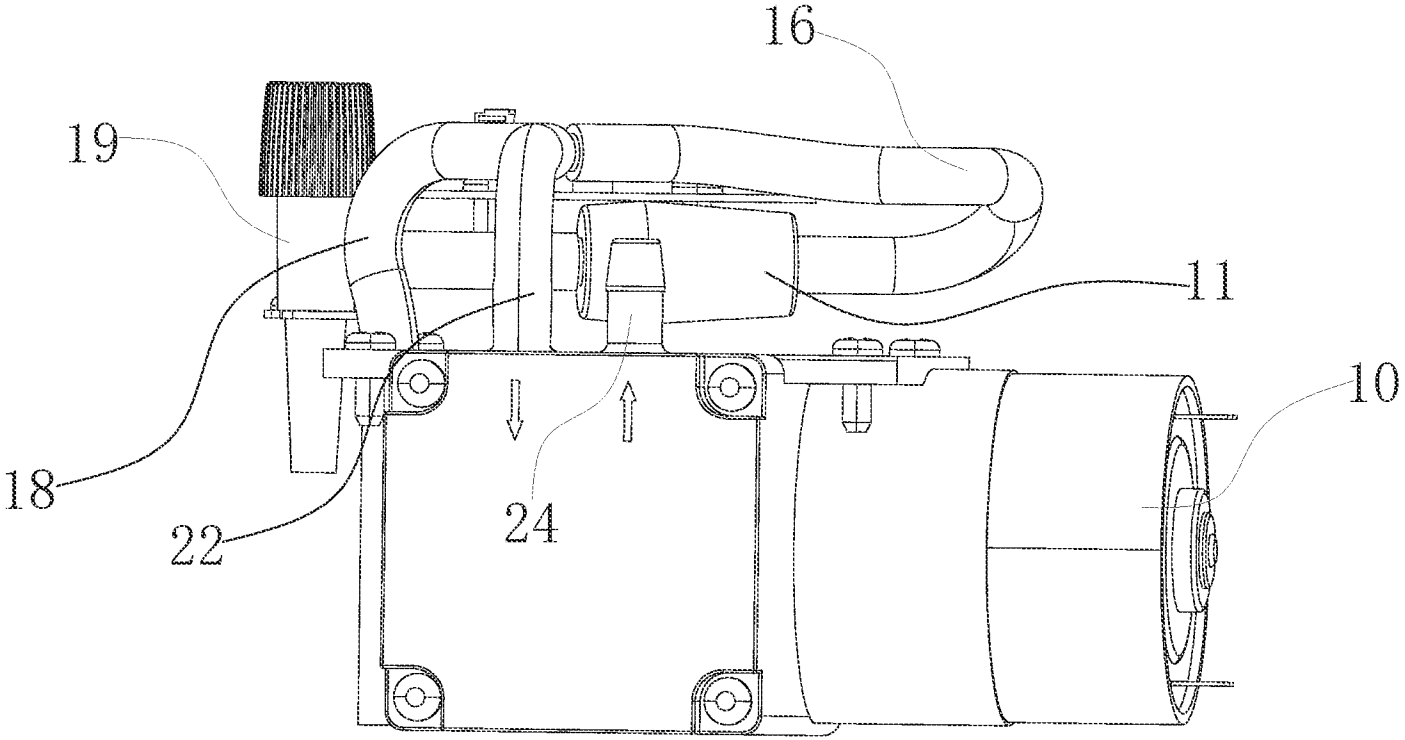
FIG. 3 is a three-dimensional schematic diagram of the motor pump and pipeline in the hand-held foam spray can shown in FIG. 2.

Referring to FIG. 3 in conjunction with FIG. 2, FIG. 3 is a three-dimensional schematic diagram of the motor pump and pipeline in the hand-held foam spray can shown in FIG. 2. In one embodiment as shown in the figure, the hand-held foam spray can 1 may further include a first pipe 16 and a second pipe 18. The first pipe 16 is for inputting air into the motor pump 10. The second pipe 18 is for inputting solution into the motor pump 10. The first pipe 16 and the second pipe 18 respectively input air and solution to the motor pump 10, which can effectively control the air injection amount and the solution input amount and speed, which helps to further accurately control the gas-liquid mixing ratio of the liquid-gas mixture.

In one embodiment, the hand-held foam spray can 1 may further include a regulating valve 19. The regulating valve 19 is connected between the first pipe 16 and the motor pump 10 to regulate the air volume of the first pipe 16 to the motor pump 10. In other words, the amount of air injected from the first pipe 16 to the motor pump 10 is regulated by the regulating valve 19, so as to further regulate the gas-liquid mixing ratio of the liquid-gas mixture, thereby regulating the quality of the foam sprayed from the nozzle 14 of the hand-held foam spray can 1.

In one embodiment, the hand-held foam spray can 1 may further include a one-way valve 11. The one-way valve 11 is arranged between the first pipe 16 and the motor pump 10, to prevent the solution from being counteracted from the first pipe 16 when the hand-held foam spray can 1 falling over.

In another embodiment, the hand-held foam spray can 1 may further include a filter screen (not shown in the FIG.). The filter screen is arranged between the first pipe 16 and the motor pump 10, for filtering the air from the first pipeline 16 to the motor pump 10. The filter screen may prevent impurities carried in the air from entering the foaming tube 12 to block the foaming tube 12, thereby affecting the mixing effect or foaming effect of the liquid-gas mixture in the foaming tube 12.

As shown in the implementation state of FIG. 1 and FIG. 2, the hand-held foam spray can 1 may include a pot body 20 and a lid body 30. The pot body 20 is used to contain the solution. The lid body 30 is used to contain the motor pump 10, the foaming tube 12, the first pipe 16 and the second pipe 18. The pot body 20 and the lid body 30 are connected and fixed in a screw threading manner, but they are not limited to this. They can also be connected in a snap-locking manner, and the two can be connected, fixed and sealed.

One end of the second pipe 18 is connected to the motor pump 10, and the other end extends into the pot body 20 to extract the solution. The solution includes water and detergent. The ratio of water to detergent in the solution is between 1000:1 and 1:1. The capacity of the pot body 20 of the hand-held foam spray can 1 is 1 to 2.5 liters (1000 to 2500 ml). For example, when the amount of water in the solution is 1000 ml, only 5 ml of detergent are mixed with water, and a rich foam can be sprayed from the nozzle 14 through the foaming tube 12. Compared with the existing foam spray can, it can save the amount of detergent and achieve better foaming effect. Please refer to FIG. 2 again, one end of the second pipe 18 is extending into the pot body 20, and a filter 180 is connected to the end to filter the solution in the pot body 20. In this way, when different types of solutions or detergents are mixed in the pot body 20, the foaming effect of the liquid-gas mixture in the foaming tube 12, such as the volume of foaming and the density of the foam, can be further improved. Depending on the type of the solution, different filters 180 can be used. In the example of FIG. 2, the filter 180 is a filter screen.

Figure 4:
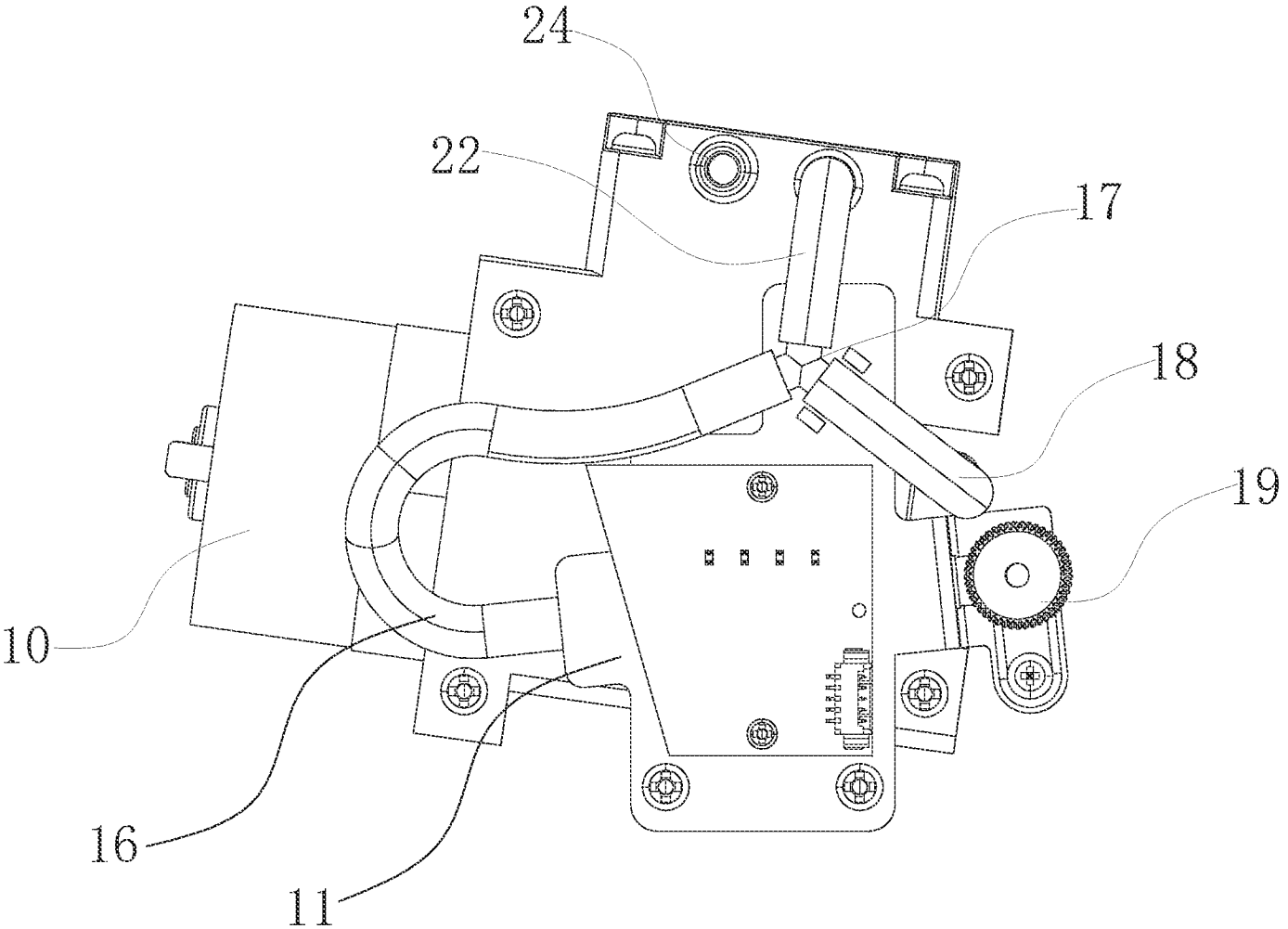
FIG. 4 is a top view of the motor pump and pipeline shown in FIG. 3.

Please refer to FIG. 2, FIG. 3 and FIG. 4, in the illustrated implementation mode, the regulating valve 19 is located on one side of the motor pump 10 and is connected to the first pipe 16 (input air) located above the motor pump 10. A knob 40 is arranged above the shell of the lid body 30 to control the regulating valve 19. The regulating valve 19 and the knob 40 can be connected in a screw-threaded manner. The one-way valve 11 is arranged between the first pipe 16 and the motor pump 10, and is at one end of the first pipe 16 near the regulating valve 19. The second pipe 18 and the regulating valve 19 are located on the same side of the motor pump 10, and the solution is drawn from the pot body 20 and fed into the motor pump 10 through the second pipe 18. After the air input from the first pipe 16 and the solution input from the second pipe 18 are mixed through a three-way joint 17, the liquid-gas mixture is input into the motor pump 10 through a third pipe 22. The motor pump 10 is connected to the foaming tube 12 through a fourth pipe 24, and pumps the liquid-gas mixture into the foaming tube 12 (shown by the arrow in FIG. 3) for mixing and foaming, and then the bubbles are sprayed out from the nozzle 14. The foaming tube 12 is arranged inside the housing of the lid body 30 in a spiral manner. When different detergents are used, adjusting the air intake may change or adjust the foam density. The more air and the denser the foam, the better the cleaning power, and the less the use of relative detergent.

In one embodiment, those pipes (16,18,22,24) are located above the motor pump 10, and the foaming tube 12 may be arranged above the motor pump 10 in a manner of circling the pipes, and then arranged inside the housing of the lid body 30. The foaming tube 12 has a certain flexibility to facilitate coiling, and the coiling method avoids of bending which would affect the transportation of the liquid-gas mixture or even reduce the mixing effect and foaming effect in the foaming tube 12. The foaming tube 12 is arranged in such a way that the storage space can be saved and the space in the lid body 30 can be fully utilized.

As shown in illustration, the lid body 30 may further include an upper cover 32 and a lower cover 34. The upper cover 32 and the lower cover 34 may be connected in a snap-locking manner. The lower cover 34 has a hollow cavity, which is provided with a socket 36 for accommodating the motor pump 10. The motor pump 10, the regulating valve 19 and the pipes may be installed in the socket 36. Thereby, the components are arranged in the hollow cavity of the lower cover 34 in a compact and orderly manner, so as to make full use of the space of the lid body 30. The socket 36 and the nozzle 14 are connected by a connecting member 360. In the figure, the socket 36 and the nozzle 14 may be connected and fixed by thread. One end of the foaming tube 12 passes through the connecting member 360 and is communicates with the nozzle 14.

The lid body 30 has a handle 38, and a user can hold the hand-held foam spray can 1 through the handle 38. The handle 38 can be provided with stripes to increase the friction force, so as to prevent from slipping when using the hand-held foam spray can 1. A battery 380 is arranged inside the handle 38 to provide power for the motor pump 10. The battery 380 is electrically connected to the motor pump 10. In the example shown in the figure, the battery 380 is connected to the motor pump 10 via a wire. The battery 380 may be a common disposable battery, such as triple-A battery, AA battery. The battery 380 can also be a rechargeable battery, and a charging port is provided on the lid body 30 to charge the battery 380. In the example of FIG. 1, the charging port of the upper cover 32 is covered by a waterproof plug 50 to protect the charging port from water when charging is not required. When the battery 380 needs to be charged, the waterproof plug 50 can be pulled out. One end of the waterproof plug 50 may be fixed on the cover 30 to prevent loss, however it is not limited to that, the waterproof plug 50 may also be provided separately from the lid body 30.

In one embodiment, the lid body 30 has a touch switch 60, which is located on the upper side of the handle 38 for controlling the switch of the motor pump 10. Furthermore, the touch switch 60 is located on one side of the upper cover 32, and the knob 40 is located on the other side of the upper cover 32.

To conclude, with the foam spray can provided by the present invention, the air and the solution sucked by the motor pump are fully mixed through the foaming tube, and then a rich foam is sprayed out through a nozzle without high-pressure gas injection. In particular, compared with the conventional foam spray can, the present invention only needs to use nearly 1/10 of the detergent to produce the same large amount of foam. The more air and the denser the foam, the better the cleaning power, and the less the use of relative detergent. At the same time, the hand-held foam spray can provided by the present invention has a simpler and more compact structure, and is convenient to carry and use.

The foregoing contents are detailed description of the disclosure in conjunction with specific preferred embodiments and concrete embodiments of the disclosure are not limited to these descriptions. For the person skilled in the art of the disclosure, without departing from the concept of the disclosure, simple deductions or substitutions can be made and should be included in the protection scope of the application.

What is claimed is:

1. A foam spray can, comprising:

a first pipe;

a second pipe;

a regulating valve;

a motor pump, the first pipe for inputting air into the motor pump, the second pipe for inputting solution into the motor pump, the regulating valve which is connected between the first pipe and the motor pump for adjusting the amount of air injected into the motor pump by the first pipe, sucking air and solution and pumping out the liquid-gas mixture;

a foaming tube, one end of which is connected to the motor pump, is used to transmit the liquid-gas mixture pumped by the motor pump and fully mix the air with the solution to produce foam, wherein the length of the foaming tube is between 10 cm and 500 cm, the inner diameter of the foaming tube is between 0.8 mm and 20 mm, and the pressure of the liquid-gas mixture in the foaming tube is between 8 and 32 PSI; and a nozzle is connected to the other end of the foaming tube for spraying foam.

2. The foam spray can according to claim 1, wherein the ratio of the air to the solution in the liquid-gas mixture is between 1:1 and 10:1.

3. The foam spray can according to claim 1, further comprising a pot body and a lid body, wherein the pot body is used to contain the solution, and the lid body is used to contain the motor pump, the foaming tube, the first pipe and the second pipe.

4. The foam spray can according to claim 3, wherein one end of the second pipe is connected to the motor pump, and the other end extends into the pot body to extract the solution.

5. The foam spray can according to claim 3, wherein the solution includes water and detergent.

6. The foam spray can according to claim 4, wherein the ratio of water to the detergent in the solution is between 1000:1 and 1:1.

7. The foam spray can according to claim 1, further comprising a one-way valve, which is arranged between the first pipe and the motor pump.

8. The foam spray can according to claim 3, wherein the foaming tube is arranged inside a housing of the lid body in a spiral manner.

9. The foam spray can according to claim 3, wherein the lid body further comprises an upper cover and a lower cover, the lower cover having a hollow cavity, the hollow cavity having a socket, the socket for accommodating the motor pump.

10. The foam spray can according to claim 7, wherein the lid body has a handle, and a battery is arranged inside the handle to provide power for the motor pump.

11. The foam spray can according to claim 8, wherein the lid body has a touch switch, which is located on the upper side of the handle and is used to control the switch of the motor pump.

* * * * *